US007446281B2

(12) United States Patent
Kagawa et al.

(10) Patent No.: US 7,446,281 B2
(45) Date of Patent: Nov. 4, 2008

(54) HEATING DEVICE

(75) Inventors: Toshiaki Kagawa, Nara (JP); Hiroshi Kida, Yamatokoriyama (JP); Takashi Yamanaka, Yamatokoriyama (JP); Tetsunori Mitsuoka, Tondabayashi (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 256 days.

(21) Appl. No.: 10/556,151

(22) PCT Filed: May 11, 2004

(86) PCT No.: PCT/JP2004/006252

§ 371 (c)(1),
(2), (4) Date: Nov. 9, 2005

(87) PCT Pub. No.: WO2004/100610

PCT Pub. Date: Nov. 18, 2004

(65) Prior Publication Data

US 2006/0289417 A1 Dec. 28, 2006

(30) Foreign Application Priority Data

May 12, 2003 (JP) ..... 2003-133136

(51) Int. Cl.
*H05B 1/00* (2006.01)
*G03G 15/20* (2006.01)

(52) U.S. Cl. ..... 219/216; 219/420; 219/469; 219/470; 219/471; 399/300; 399/330; 399/331; 399/332; 399/333; 399/334; 399/335; 399/336; 399/337; 399/338

(58) Field of Classification Search ..... 219/216, 219/420, 469–471; 118/60; 399/300, 330–338
See application file for complete search history.

(56) References Cited

U.S. PATENT DOCUMENTS 5,180,612 A * 1/1993 Rendell ..... 427/372.2

FOREIGN PATENT DOCUMENTS

| | | | |
|---|---|---|---|
| JP | S57161877 | | 10/1982 |
| JP | S60143373 | | 7/1985 |
| JP | 62-289879 | A | 12/1987 |
| JP | 5-188805 | * | 7/1993 |
| JP | 5-188805 | A | 7/1993 |
| JP | 7-110633 | A | 4/1995 |
| JP | 9-101700 | * | 4/1997 |
| JP | 9-101700 | A | 4/1997 |
| JP | 9-152801 | A | 6/1997 |

(Continued)

*Primary Examiner*—Shawntina Fuqua
(74) *Attorney, Agent, or Firm*—Birch, Stewart, Kolasch & Birch, LLP

(57) ABSTRACT

A fusing device (23) has heat reflectors (238) and (239) positioned in consideration of the fact that convective heat loss from respective outer surfaces of the heat reflectors (238) and (239) depends on orientation of the outer surfaces. More specifically, each of the heat reflectors (238) and (239) are positioned so as to have a convective heat transfer coefficient η of up to 0.9. The convective heat transfer coefficient η is given by the following expression:

$$\eta=(Su+0.77Sh+0.54Sd)/(Su+Sh+Sd),$$

were Su is a projected area of an outer surface of each of the heat reflectors on an upper horizontal plane, Sh is a projected area of the same on a vertical plane, and Sd is a projected area of the same on a lower horizontal plane.

5 Claims, 9 Drawing Sheets

FOREIGN PATENT DOCUMENTS

| | | | |
|---|---|---|---|
| JP | 10-149040 | A | 6/1998 |
| JP | 2002-169400 | A | 6/2002 |
| JP | 2002-189376 | A | 7/2002 |
| JP | 2003-5479 | A | 1/2003 |
| JP | 2003-107944 | A | 4/2003 |

* cited by examiner

PRIOR ART (a)

| | CROSS-SECTION | CENTER ANGLE $\theta$ | INCLINATION ANGLE $\psi$ | CONVECTIVE HEAT TRANSFER COEFFICIENT $\eta$ |
|---|---|---|---|---|
| CONVENTIONAL 1 | ARC | 180 | 90 | 0.92 |
| CONVENTIONAL 2 | ARC | 90 | 90 | 0.98 |
| INVENTION 1 | ARC | 120 | 60 | 0.89 |
| INVENTION 2 | ARC | 180 | 0 | 0.77 |
| INVENTION 3 | ARC | 90 | 0 | 0.77 |
| INVENTION 4 | ARC | 180 | -90 | 0.62 |
| INVENTION 5 | ARC | 90 | -90 | 0.56 |

(b)

HEATING DEVICE

TECHNICAL FIELD

The invention relates to heating devices configured to heat a medium to be heated by a heating member while the medium is being transported on a transport path. The invention relates in particular to heating devices provided with a heat reflector for reflecting radiant heat from the heating member.

BACKGROUND ART

Typical examples of such heating devices are: fusing devices provided in electrophotographic image forming apparatuses; drying devices for use in wet-type electrophotographic image forming apparatuses or ink jet printers; and erasing devices for rewritable media. A configuration of a fusing device provided in an image forming apparatus is described below as a representative example of conventional heating devices.

Generally, the fusing device has a heating roller and a pressure roller arranged on respective sides of a sheet transport path so that the rollers are pressed against each other. A fusing nip area is formed between the heating roller and the pressure roller as pressed against each other at a predetermined pressure. When passing through the fusing nip area, a sheet is heated and pressed, so that an unfixed toner image on the sheet is firmly fixed to the sheet. For the toner image to be properly fixed to the sheet, it is necessary to maintain the heating roller and the pressure roller at constant high temperatures. Accordingly, it is important that the heating roller and the pressure roller have heat-retaining properties.

FIG. 1 is a diagram illustrating a configuration of a conventional fusing device according to a fusing method using a heating roller. A heat reflector 238 is made of metal and has an arc-shaped cross-section. Provided for reflecting radiant heat from the heating roller 231, the heat reflector 238 is positioned so as to cover partially a circumference of the heating roller 231. The heat reflector 238 thus serves to reduce heat loss from the heating roller 231 and enhance heat-retaining properties of the roller 231, thereby allowing the fusing device to save energy (see Patent Literature 1).

However, conventional art including the Patent Literature 1 has not dealt with heat loss from heat reflectors. With reference to FIG. 1, focus is merely on reflecting radiant heat from the heating roller 231 by the heat reflector 238. Convective heat loss from an outer surface of the heat reflector 238, i.e., a surface thereof opposite to a surface facing the heating roller 231, has not been dealt with.

Therefore, a great amount of heat loss from the outer surface of the heat reflector 238 prevents the heating roller 231 from retaining heat. Especially for high-speed printing machines that allow 50 or more sheets to be printed per minute and a sheet to be transported through a fusing nip area in 23 or less msec, it is important that a heating roller and a pressure roller have heat-retaining properties. This is because fusing devices provided in such high-speed printing machines tend to encounter a problem of insufficiency of heat.

A feature of the invention is to provide a heating device that reduces convective heat loss from a heat reflector, thereby enhancing heat-retaining properties of a heating member.

Patent Literature 1: JP H9-101700 A

SUMMARY OF THE INVENTION (1) A heating device of the invention includes a heating member and a heat reflector. The heating member is provided for heating a medium to be heated and is arranged so as to be close to a transport path on which the medium is transported. The heat reflector is provided for reflecting radiant heat from the heating member. The heat reflector is positioned across the heating member from the transport path so as to face the heating member. The heat reflector is located at a predetermined position around the heating member so as to have a convective heat transfer coefficient $\eta$ of up to 0.9. The convective heat transfer coefficient $\eta$ is given by the following equation:

$$\eta=(Su+0.77Sh+0.54Sd)/(Su+Sh+Sd),$$

where Su is an area projected on an upper horizontal plane, of an opposite surface of the heat reflector to a surface thereof facing the heating member, Sh is an area of the same projected on a vertical plane, and Sd is an area of the same projected on a lower horizontal plane.

The heat reflector is positioned in such a manner as to reduce heat loss therefrom. Amount of heat loss from the heat reflector depends on orientation of the opposite surface thereof, i.e., an outer surface thereof. In the heat reflector, a largest amount of heat escapes upwards, a next largest amount escapes laterally, and a smallest amount escapes downwards. Specifically, laboratory experiments conducted by the applicants showed that the ratio of amount of heat escaping upwards, laterally, and downwards is 1:0.77:0.54.

Convective heat transfer coefficient $\eta$ is given by the following expression that is formulated in view of the foregoing:

$$\eta=(Su+0.77Sh+0.54Sd)/(Su+Sh+Sd).$$

In the invention, the heat reflector is located at a predetermined position around the heating member so as to have a minimum convective heat transfer coefficient $\eta$.

The heat reflector as thus located allows convective heat loss therefrom to be reduced, thereby enhancing heat-retaining properties of the heating member. Laboratory experiments conducted by the applicants showed that the heating member has enhanced heat-retaining properties when the convective heat transfer coefficient $\eta$ is 0.9 or smaller.

(2) In an aspect of the invention, the heating member has an internal heat source.

In the aspect, the heat reflector is positioned so as to cover partially a circumference of the heating member that has the internal heat source. The heat reflector reflects radiant heat from the heating member more effectively than when the heating member does not have an internal heat source. The heat reflector is thus used effectively.

(3) In another aspect of the invention, the transport path is inclined at an angle with respect to a horizontal plane, along a transport direction in which the medium is transported.

In the aspect, the transport path on which the medium is transported is inclined at an angle with respect to the horizontal plane. When the transport path is inclined at 90 degrees with the horizontal plane, the medium is transported in an approximately vertical direction. There is a reduction in projected area of the outer surface of the heat reflector on an upper horizontal plane. Heat loss from the outer surface is thus reduced, compared to a case in which the transport path is formed along a horizontal direction. Accordingly, the heating member has enhanced heat-retaining properties.

(4) In another aspect of the invention, the heating member has a heating roller and a pressure roller. The heating roller and the pressure roller are arranged on respective sides of the transport path so as to be pressed against each other. The heat reflector is positioned so as to cover at least a circumferential surface of the heating roller.

In the aspect, the heating member has the heating roller provided with the internal heat source and the pressure roller positioned so as to be pressed against the heating roller. When the heat reflector is positioned so as to reflect at least radiant heat from the heating roller, the heat reflector allows the heating member to have enhanced heat-retaining properties.

The heat reflector is usually easy to be positioned in a space at a side of the heating roller at which the transport path is not formed. The positioning facilitates adjustment of an angle of the heat reflector, thereby facilitating enhancement of heat-retaining properties of the heating member.

(5) In another aspect of the invention, the heating device further includes a velocity adjusting section for adjusting a circumferential velocity V of the heating roller so that the circumferential velocity V falls within a range given by the following inequality: 0.32 (m/s)≦V≦0.49 (m/s).

In the aspect, the circumferential velocity of the heating roller is adjusted in view of heat loss in the vicinity of the circumferential surface of the heating roller. When the heating roller is rotated in a downward direction on a side facing the heat reflector, rotation of the heating roller causes a downward flow of heated air between the heating roller and the heat reflector. When the circumferential velocity V of the heating roller is adjusted so as to fall within a range of 0.32 (m/s)≦V≦0.49 (m/s), buoyancy of the heated air is approximately equal to a force to cause the downward flow of heated air.

Accordingly, heated air around the heating roller is less likely to escape from the vicinity of the heating roller, so that the heating roller has enhanced heat-retaining properties.

(6) In another aspect of the invention, the heating device further includes an external heating roller and a heat reflector. The external heating roller is provided for pressing against and heating the pressure roller. The heat reflector is provided for reflecting radiant heat from the external heating roller. The heat reflector is positioned so as to face the external heating roller. The external heating roller is positioned in direct contact with the pressure roller at an area on a lower half of a circumferential surface of the pressure roller.

In the aspect, the pressure roller is supplied with heat by not only a contact portion of the heating roller but also the external heating roller that is provided with the heat reflector for reflecting radiant heat from the external heating roller.

The external heating roller allows the pressure roller to be maintained at a high temperature, thereby enhancing heat-retaining properties of the pressure roller. Also, the heat reflector as thus positioned allows an increase in projected area of an outer surface thereof on a lower horizontal plane, thereby allowing heat loss from the outer surface to be reduced.

(7) In another aspect of the invention, the heat reflector is divided into multiple parts along a circumferential direction thereof.

In the aspect, the heat reflector is divided into discontinuous parts along the circumferential direction thereof, so that heat is less likely to transfer from a middle part or a lower part to an upper part. Accordingly, the heat reflector as a whole is less likely to have a decrease in temperature.

(8) In another aspect of the invention, the heat reflector includes a material of low thermal conductivity.

In the aspect, the heat reflector includes the material that prevents heat conduction among portions of the heat reflector. Thus, heat is less likely to escape internally from a middle part or a lower portion to an upper portion. Accordingly, the heat reflector has enhanced heat-retaining properties, thereby improving heat-retaining properties of the heating member.

DETAILED DESCRIPTION OF THE INVENTION

With reference to the accompanying drawings, an embodiment of the invention will be described below. In the embodiment, a digital copying machine 1 is provided with a fusing device to which the heating device of the invention is applied to.

Figure 1:
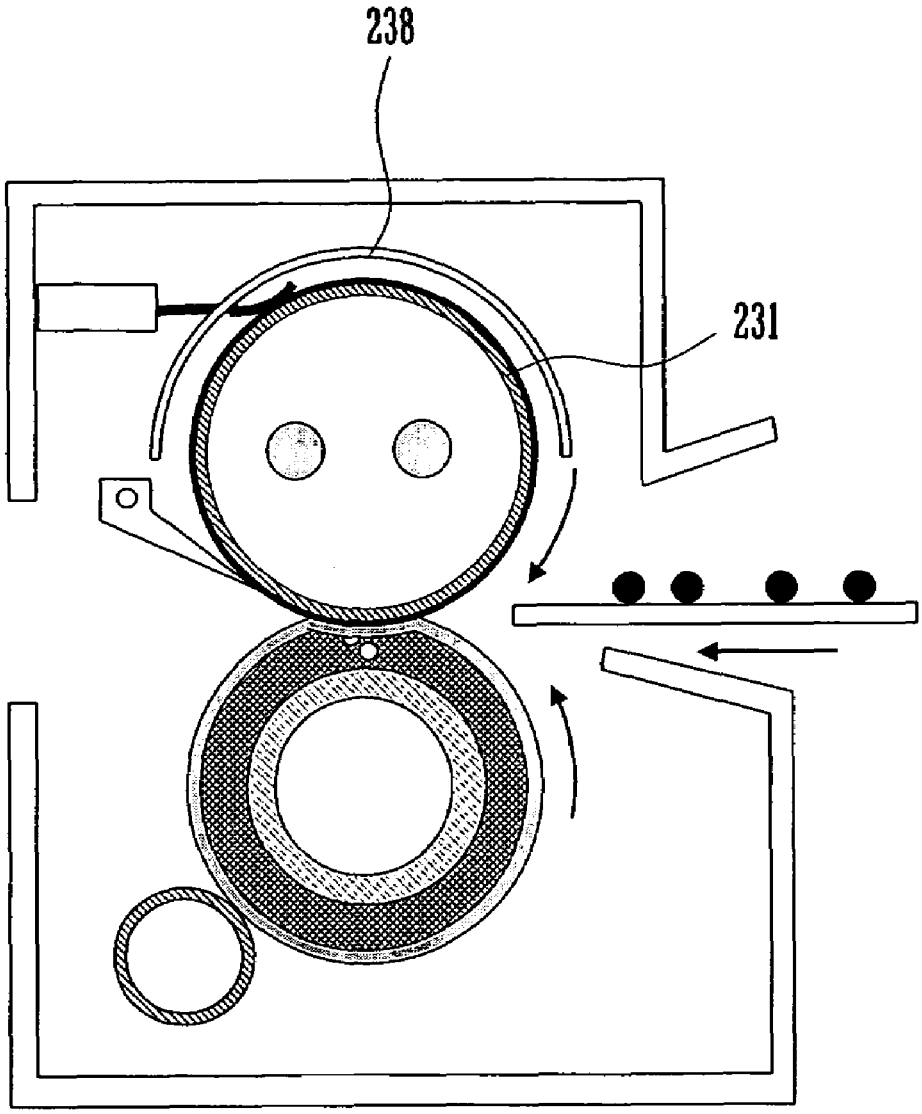
FIG. 1 is a diagram illustrating a conventional heat reflector.
Figure 2:
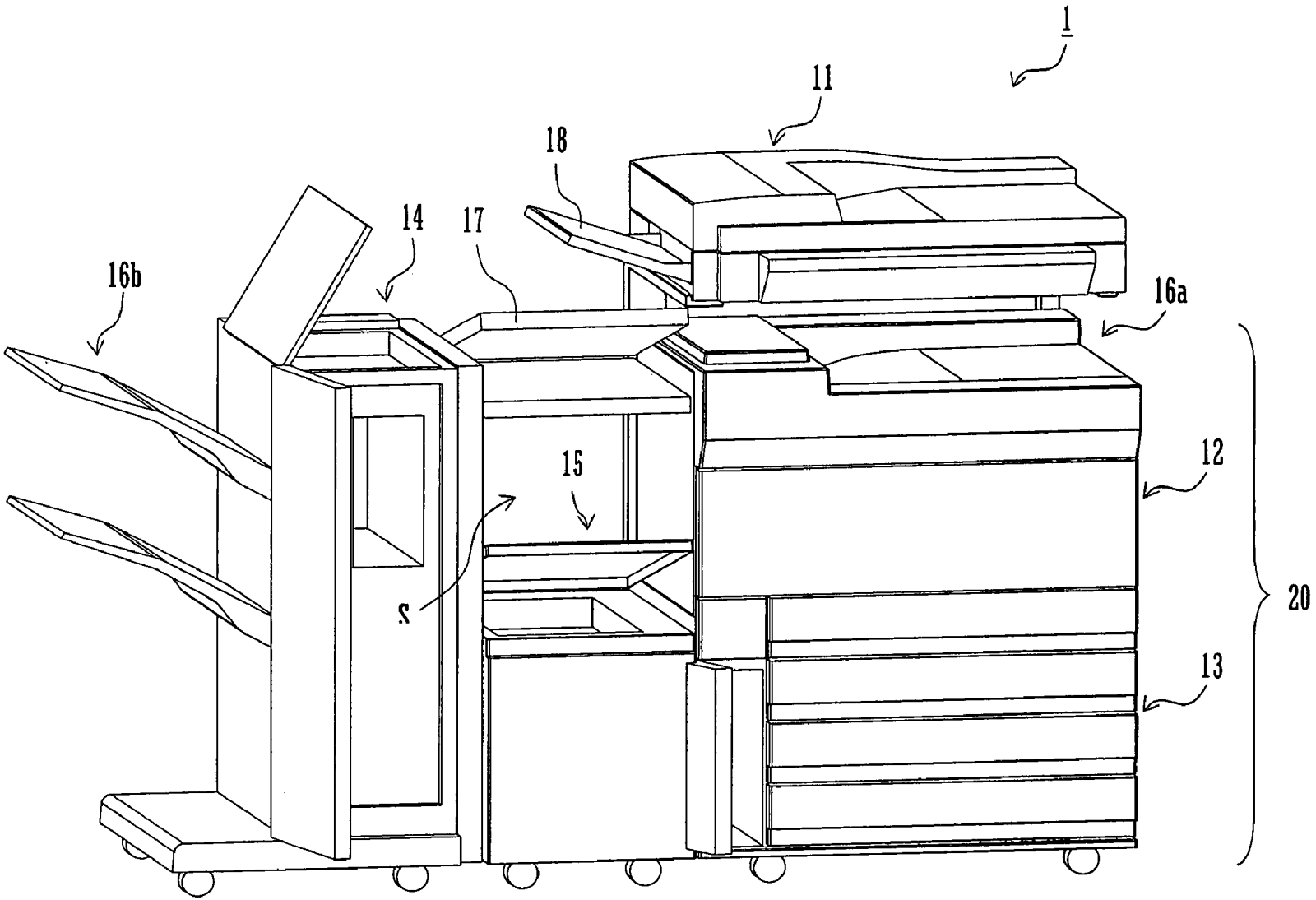
FIG. 2 is a perspective view illustrating a configuration of a digital copying machine provided with a heating device of the invention.

FIG. 2 is a perspective view illustrating a configuration of the digital copying machine 1. The digital copying machine 1 includes a document reading device 11, an image forming device 12, a sheet feeding device 13, a finishing device 14, an external sheet feeding device 15, a transporting section 17, and sheet output trays 16*a* and 16*b*.

The document reading device 11 reads an image of a document and sends image data as read to the image forming device 12. The image forming device 12 performs an electrophotographic image forming process based on the input image data. The sheet feeding device 13 feeds the image forming device 12 with a sheet for an image to be formed thereon. The transporting section 17 transports a sheet on which the image forming device 12 forms an image, to the finishing device 14. The finishing device 14 performs finishing operations such as stapling or sorting sheets, depending on image forming jobs as input. The external sheet feeding device 15 has a sheet storage capable of storing a large quantity of sheets. As well as the sheet feeding device 13, the external sheet feeding device 15 feeds the image forming device 12 with a sheet for an image to be formed thereon. The sheet output trays 16*a* and 16*b* receive a sheet that is output from the digital copying machine 1 after undergoing an image forming process.

Figure 3:
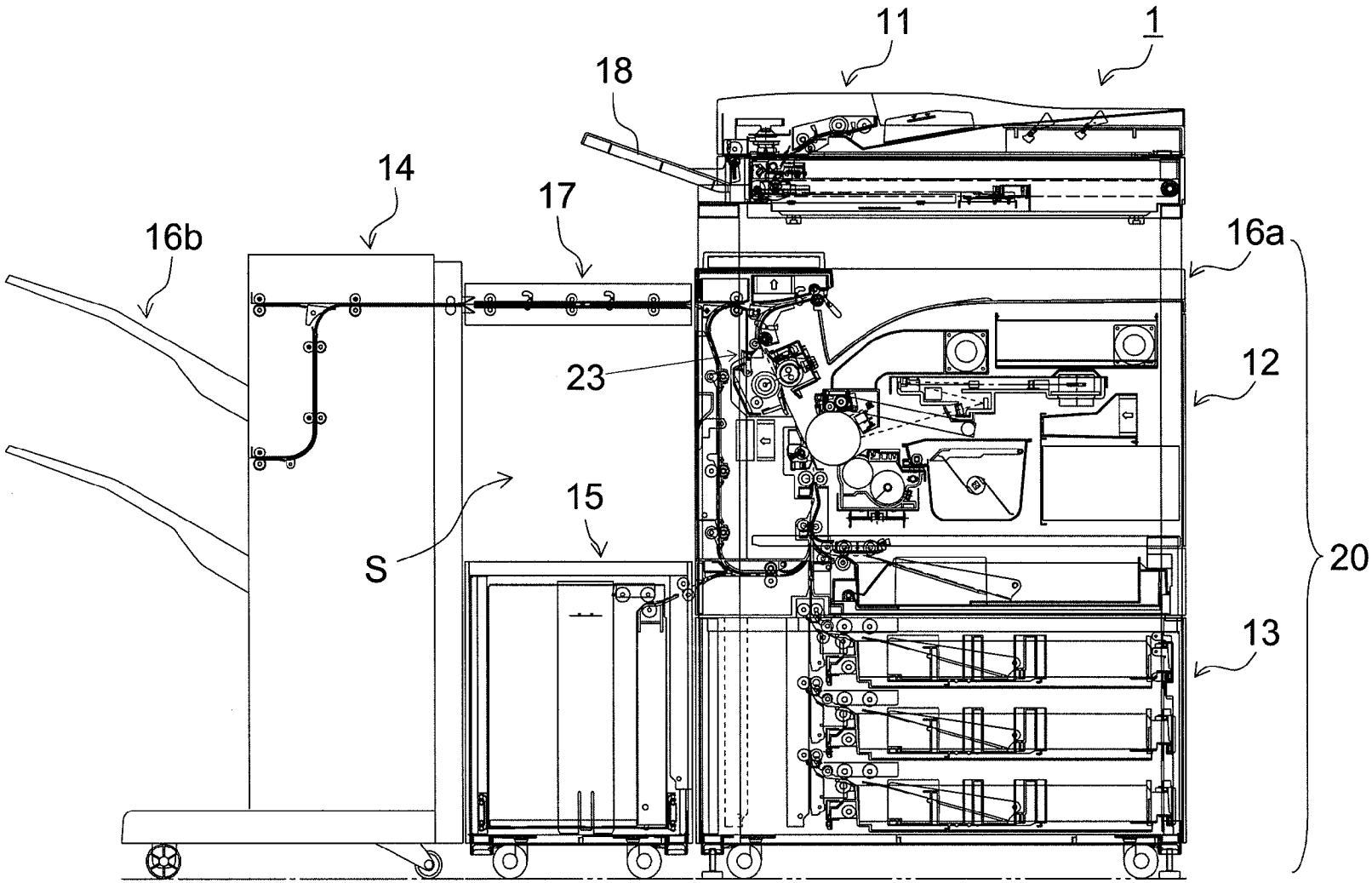
FIG. 3 is a schematic diagram illustrating an inner construction of the digital copying machine.

FIG. 3 is a schematic diagram illustrating an inner construction of the digital copying machine 1. A sheet transport path is formed so as to lead either from the sheet storage in the sheet feeding device 13 or from the external sheet feeding device 15, through the image forming device 12, the transporting section 17, and the finishing device 14, to the sheet output tray 16*b*. A fusing device 23 corresponds to the heating device of the invention. The fusing device 23 is positioned in the image forming device 12 so as to abut onto the sheet transport path.

Figure 4:
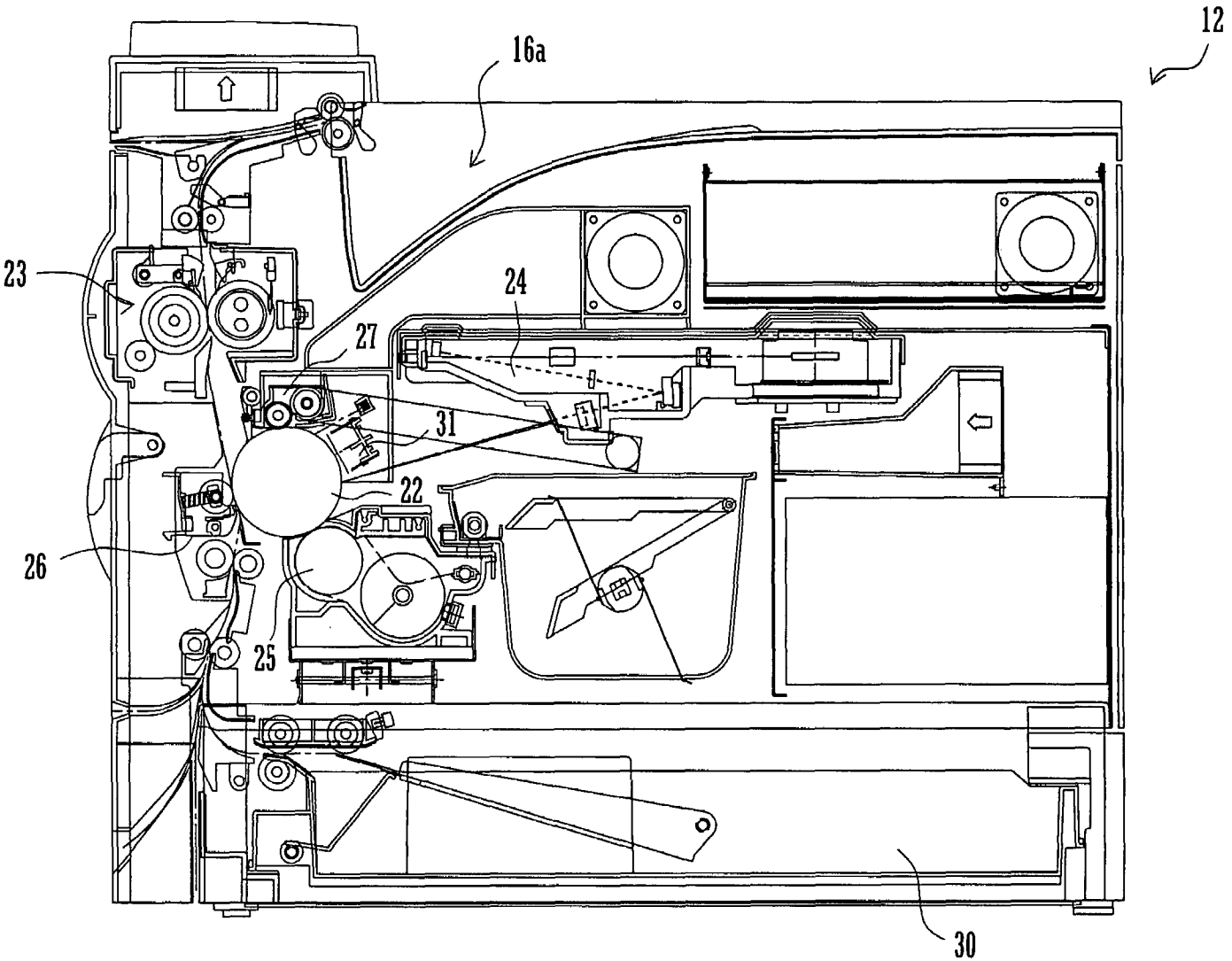
FIG. 4 is a diagram illustrating a configuration of an image forming apparatus provided with the heating device of the invention.

FIG. 4 is a diagram illustrating a configuration of the image forming device 12. As shown in FIG. 4, a photoreceptor drum 22 as an image bearing member is positioned so as to abut onto the sheet transport path. Arranged around the photoreceptor drum 22 are a charging unit 31, an optical scanning unit 24, a developing unit 25, a transferring unit 26, and a cleaning unit 27.

The charging unit 31 uniformly charges a circumferential surface of the photoreceptor drum 22. The optical scanning unit 24 irradiates the charged surface of the photoreceptor drum 22 with light, thereby forming an electrostatic latent image on the surface of the photoreceptor drum 22. The developing unit 25 develops the electrostatic latent image with developer into a developer image. The transferring unit 26 transfers the developer image formed on the circumferential surface of the photoreceptor drum 22 to a sheet. The cleaning unit 27 removes residual developer remaining on the circumferential surface of the photoreceptor drum 22, in preparation for a new image to be formed on the photoreceptor drum 22.

An image forming position is located between the photoreceptor drum 22 and the transferring unit 26. The fusing device 23 is positioned downstream of the image forming position along the sheet transport path. By the fusing device 23, a developer image on a sheet is fixed to the sheet. The sheet with the developer image fixed thereto is output to the sheet output tray 16*a* or to the sheet output tray 16*b*, with an image-formed side of the sheet down. The residual developer removed by the cleaning unit 27 is collected and returned to the developing unit 25 for reuse.

In a space surrounding the optical scanning unit 24, a process control unit (PCU) board, an interface board, an image control unit (ICU) board, and a power supply unit are provided.

The PCU board controls a not-shown electrophotographic processing section. Through the interface board, the digital copying machine 1 receives image data that is input externally. The ICU board performs a predetermined image processing operation to image data received through the interface board or read by the document reading device 11, and outputs the resulting data to the optical scanning unit 24. The power supply unit supplies electric power to components, including the boards as described above, of the digital copying machine 1.

Figure 5:
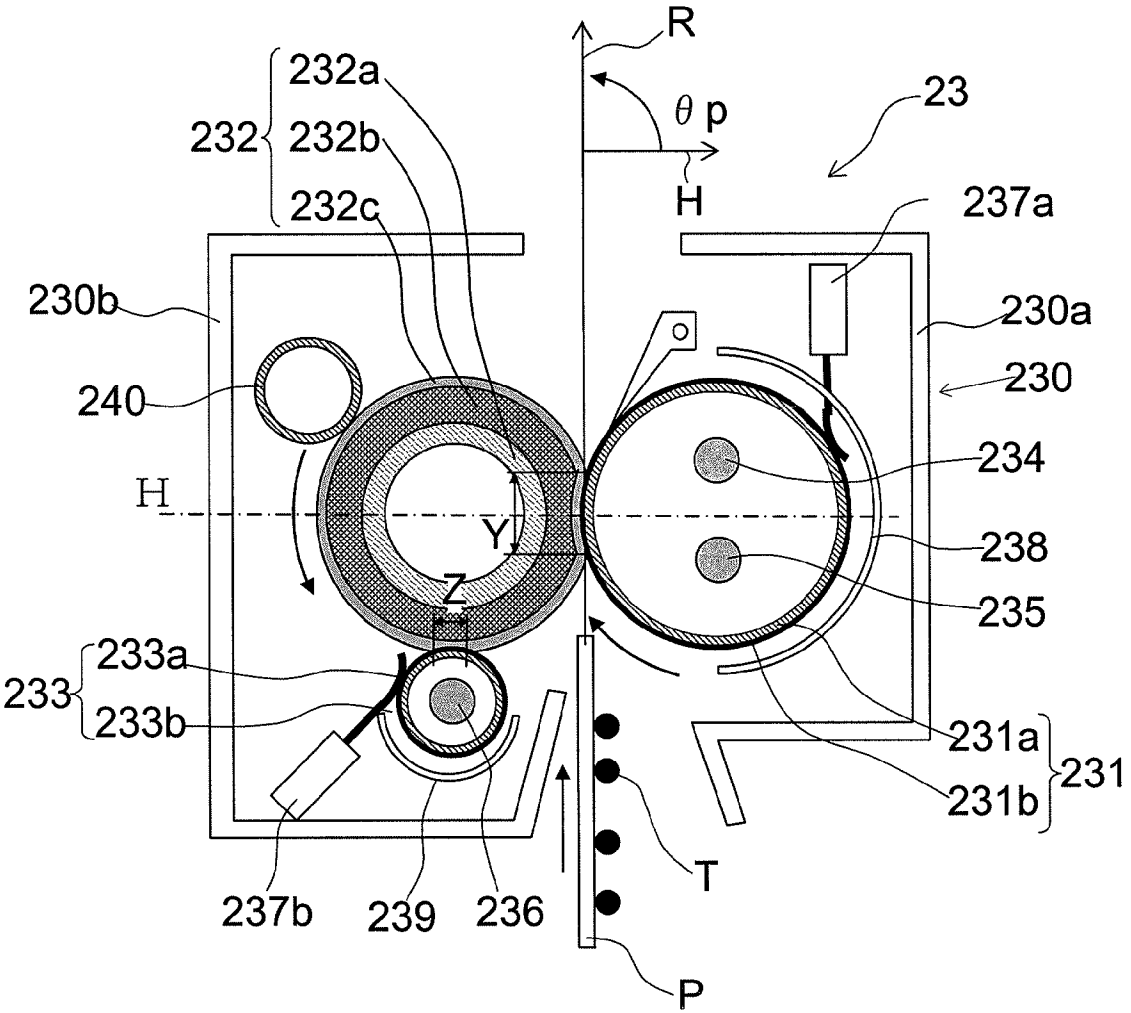
FIG. 5 is a diagram illustrating a configuration of a fusing device as the heating device of the invention.
Figure 6:
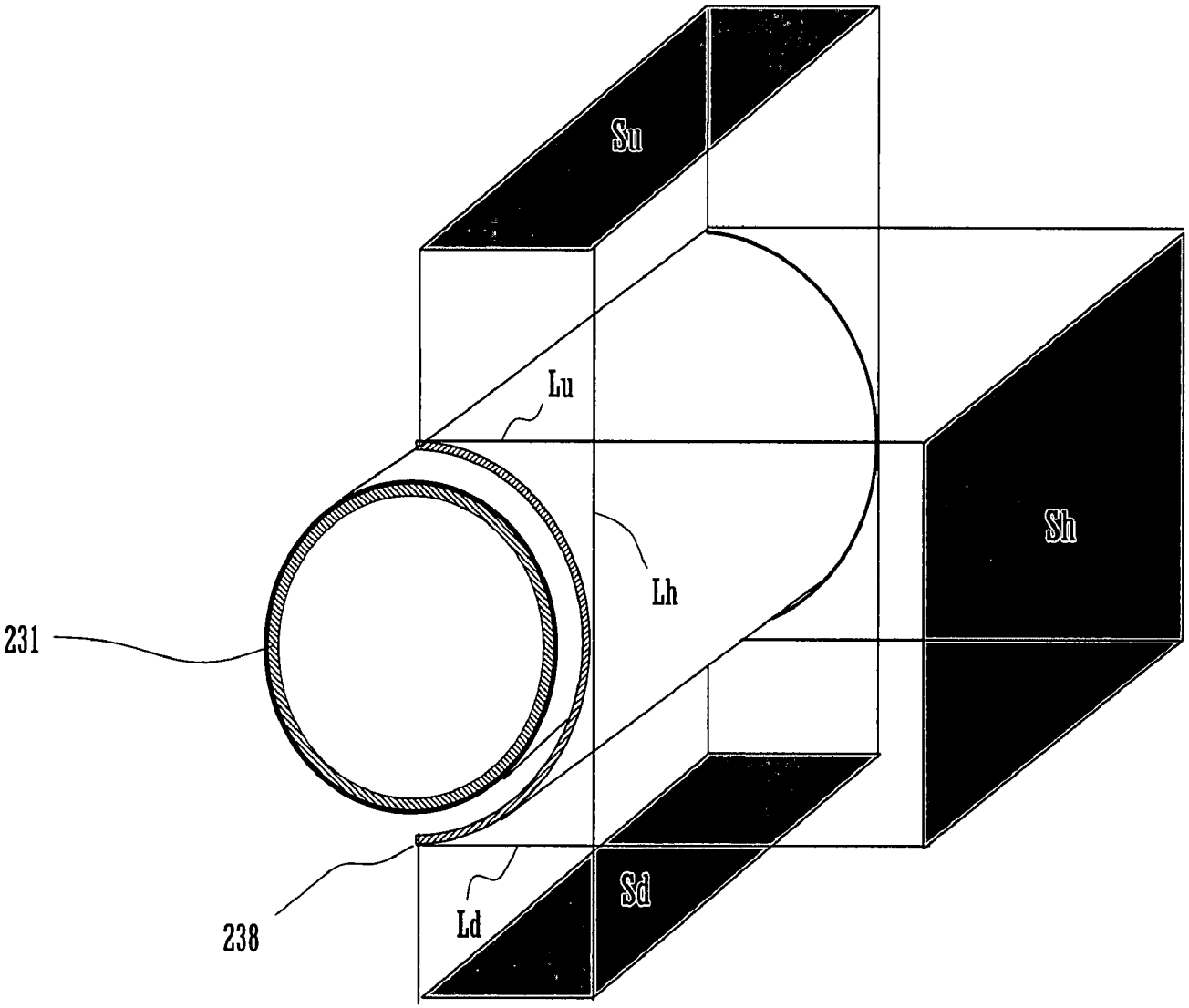
FIG. 6 is a diagram illustrating respective projected areas of the heat reflector.

FIG. 5 is a diagram illustrating a configuration of the fusing device 23 according to the present embodiment. The fusing device 23 includes a heating roller 231 and a pressure roller 232. The heating roller 231 and the pressure roller 232 are arranged on respective sides of the sheet transport path, so as to be pressed against each other.

A portion of the sheet transport path that runs between the heating roller 231 and the pressure roller 232 is inclined at an angle with respect to a horizontal plane. In the present embodiment, the sheet transport path inside the fusing device 23 is approximately perpendicular to the horizontal plane. The heating roller 231 has internal heater lamps 234 and 235 as heat sources. The pressure roller 232 is heated by an external heating roller 233 as the external heating device of the invention. The external heating roller 233 has an internal heater lamp 236 as a heat source.

The heater lamps 234 to 236 are halogen heaters that have respective predetermined heat distributions. The heater lamps 234 to 236 are energized, by a not-shown control circuit, to emit visible light as well as infrared rays to heat respective inner circumferential surfaces of the heating roller 231 and the external heating roller 233.

The fusing device 23 also includes temperature sensors 237*a* and 237*b* and a cleaning roller 240. The temperature sensors 237*a* and 237*b* are provided for detecting respective circumferential surface temperatures of the heating roller 231 and the external heating roller 233. The cleaning roller 240 is provided for cleaning a circumferential surface of the pressure roller 232.

The foregoing components of the fusing device 23 are covered with a cover 230 that is divided into a heating-side cover 230*a* and a pressure-side cover 230*b*.

Inside the cover 230, a heat reflector 238 is placed so as to face the circumferential surface of the heating roller 231. The heat reflector 238 has an arc-shaped cross-section. The heat reflector 238 reflects radiant heat from the heating roller 231.

Furthermore, a heat reflector 239 is placed so as to face the circumferential surface of the external heating roller 233. The heat reflector 239 also has an arc-shaped cross-section. The heat reflector 239 reflects radiant heat from the external heating roller 233.

As shown in FIG. 5, the heat reflector 238 is positioned across the heating roller 231 from the sheet transport path. The heat reflector 239 is positioned across the external heating roller 233 from the pressure roller 232. An important feature of the invention is the positions of the heat reflectors 238 and 239 as described later in detail.

The heating roller 231 is heated by the heater lamps 234 and 235 so that the outer circumferential surface thereof has a predetermined temperature. In the present embodiment, the outer circumferential surface of the heating roller 231 has a temperature of 200° C. While a sheet P with an unfixed toner image T transferred thereon is passing through a fusing nip area of the fusing device 23, the heating roller 231 heats the sheet P.

The heating roller 231 includes a metal core 231*a* and a releasing layer 231*b* formed on an outer circumferential surface of the metal core 231*a*. The releasing layer 231*b* prevents toner offset of the toner image T. The metal core 231*a* is made of metal such as iron, stainless steel, aluminum, or copper, or alloy of the mentioned metals. The metal core 231*a* used in the present embodiment is an iron (STKM) core having a diameter of 40 mm and a wall thickness of 1.3 mm. Suitable materials for the releasing layer 231*b* are silicone rubber, fluorocarbon rubber, fluorine resins such as PFA (copolymer of tetrafluoroethylene and perfluoro-alkylvinylether) or PTFE (polytetrafluoroethylene), etc. In the present embodiment, the releasing layer 231*b* are formed by applying a 25 μm thickness of blend of PFA and PTFE to the metal core 231*a* and then calcining the applied blend. The heater lamps 234 and 235 in the present embodiment have rated outputs of 850 W in total.

The pressure roller 232 includes a metal core 232*a* and a heat-resistant elastic layer 232*b* formed on an outer circumferential surface of the metal core 232*a*. The metal core 232*a* is made of metal such as iron, stainless steel, or aluminum. The layer 232*b* is made of material such as silicone rubber. A releasing layer 232*c* of fluorine resin, which is similar to the releasing layer 231*b*, is formed on the layer 232*b*. The pressure roller 232 in the present embodiment has a diameter of 40 mm. The layer 232*b* is made of silicone rubber and has a thickness of 6 mm. The releasing layer 232*c* is made of a PFA tube of a thickness of 50 μm. To the pressure roller 232, a not-shown elastic member such as a spring applies a force toward the heating roller 231. Thus, the pressure roller 232 is pressed against the heating roller 231 with a pressure force of 745 N. The pressure force causes a fusing nip area Y of width of approximately 6 mm to be formed between the heating roller 231 and the pressure roller 232.

The external heating roller 233 is provided upstream of the fusing nip area Y in the sheet transport path. The external heating roller 233 is pressed against the pressure roller 232 with a predetermined force. Thus, a heating nip area Z of width of approximately 1 mm is formed between the external heating roller 233 and the pressure roller 232. The external heating roller 233 includes a metal core 233*a* and a heat-resistant releasing layer 233*b* formed on the metal core 233*a*. The metal core 233*a* is a hollow cylinder of metal such as aluminum or ferrous material. The heat-resistant releasing layer 233*b* is made of synthetic resin material that has good heat-resisting and releasing properties. Examples of such synthetic resin material include, but are not limited to, elastomers such as silicone rubber or fluorocarbon rubber, and fluorine resins such as PFA or PTFE.

In the present embodiment, the metal core 233*a* is a cylindrical aluminum shaft with a diameter of 15 mm and a wall thickness of 0.5 mm. The heat-resistant releasing layer 233*b* are formed by applying a 25 μm thickness of blend of PFA and PTFE to the metal core 233*a* and then calcining the applied blend. The heater lamp 236 has a rated output of 300 W.

The cleaning roller 240 removes toner and paper dust that adhere to the pressure roller 232, thereby preventing the toner and paper dust from adhering to the external heating roller 233. The cleaning roller 240 is provided upstream of the heating nip area Z along a direction in which the pressure roller 232 is rotated. The cleaning roller 240 is pressed against the pressure roller 232 with a predetermined force. The cleaning roller 240 is rotatably supported so as to be driven by rotation of the pressure roller 232. The cleaning roller 240 includes a cylindrical core of metal such as aluminum or ferrous material. In the present embodiment, the cleaning roller 240 has a core of stainless steel material.

As described above, the temperature sensors 237*a* and 237*b* are arranged on the respective circumferential surfaces of the heating roller 231 and the external heating roller 233. The temperature sensors 237*a* and 237*b* detect the respective circumferential surface temperatures of the heating roller 231 and the external heating roller 233. Based on the detection results, the not-shown control circuit adjusts amount of electric current to supply to the heater lamps 234 to 236.

In the present embodiment, the fusing device 23 is operated mainly either in a warm-up mode or in a copy mode. In the warm-up mode, a driving motor is activated to rotate the heating roller 231 at a circumferential velocity (fusing velocity) of 365 mm/s. Simultaneously, the heater lamps 234 to 236 are energized to heat the external heating roller 233, the heating roller 231, and the pressure roller 232 until the circumferential surface temperatures of the rollers 233, 231, and 232 reach respective predetermined temperatures. In the present embodiment, the predetermined temperatures are 190° C. for the external heating roller 233, 200° C. for the heating roller 231, and 150° C. for the pressure roller 232, respectively.

In the copy mode, the heater lamps 234 to 236 are energized so that surface temperature T1 of the heating roller 231 is maintained at 200° C. and surface temperature T2 of the pressure roller 232 is maintained at 135° C. The heater lamp 236 for the external heating roller 233 is set at a temperature of 170° C. that is required for maintaining the surface temperature T2 at 135° C. Then, a sheet P with an unfixed toner image T formed thereon is transported to the fusing nip area Y, and the toner image T is fused and fixed onto the sheet P. The sheet P takes approximately 16.4 msec to pass through the fusing nip area Y.

Next described below is an important feature of the invention, i.e., a manner in which the fusing device 23 is positioned in the image forming device 12. Orientation of the fusing device 23 is hereinafter represented by a direction in which a sheet P is transported between the heating roller 231 and the pressure roller 232, i.e., a sheet transport direction. More specifically, an angle of the sheet transport path is represented by a counterclockwise angle (θp) with respect to a horizontal plane as depicted by a line H.

Regarding conventional fusing devices provided in high-speed copying machines, a heating roller 231 and a pressure roller 232 are normally aligned vertically such that a sheet P is transported in a horizontal direction (i.e., with the angle θp being 0° or 180°). In the present embodiment, in contrast, the sheet transport path is formed such that a sheet P is transported in a vertical direction (i.e., with the angle θp being 90°). Accordingly, the heating roller 231 and the pressure roller 232 are positioned in horizontal alignment on respective sides of the sheet transport path.

In the fusing device 23, the heat reflector 238 is positioned laterally with respect to the heating roller 231 with a space of approximately 2 mm formed between the heat reflector 238 and the circumferential surface of the heating roller 231. The heat reflector 238 is made of stainless steel and has an arc-shaped cross-section.

The external heating roller 233 is positioned below the pressure roller 232. The heat reflector 239 is positioned below the external heating roller 233 with a space of approximately 2 mm formed between the heat reflector 239 and the circumferential surface of the external heating roller 233. The heat reflector 239 is made of stainless steel and has an arc-shaped cross-section.

Because of being positioned close to the heating roller 231, the heat reflector 238 is caused to rise in temperature by heat transfer through air or by convective heat transfer, even when the heat reflector 238 almost completely reflects radiant heat from the heating roller 231. When reaching a high temperature, the heat reflector 238 starts to lose heat, due to convective heat transfer, from an outer surface thereof, i.e., from a surface opposite to a surface facing the heating roller 231.

Amount of the convective heat loss depends on orientation of a surface from which heat is lost. In coefficient of natural convective heat transfer in infinite space, according to Mikheev's method, a top surface of a horizontal flat plate shows a increase by 30% and a bottom surface of the same shows a decrease by 30%, compared to a surface of a vertical flat plate.

More specifically, the ratio of amount of heat loss among the top, vertical, and bottom surfaces is 1:0.77:0.54. Thus, less heat is lost from the vertical and bottom surfaces than from the top surface.

In the present embodiment, therefore, the heat reflectors 238 and 239 are positioned with respective outer surfaces thereof oriented laterally or downward. The positioning allows convective heat loss from the reflectors 238 and 239 to be reduced. In the present invention, convective heat transfer coefficient η is calculated from the expression as presented below.

$$\eta=(Su+0.77Sh+0.54Sd)/(Su+Sh+Sd), \qquad \text{Expression (1)}$$

where Su is a projected area on an upper horizontal plane of an outer surface of the heat reflector 238, i.e., an opposite surface thereof to a surface facing the heating roller 231, Sh is a projected area of the same on a vertical plane, and Sd is a projected area of the same on a lower horizontal plane. In the invention, as described above, the applicants focus on the projected areas on the upper and lower horizontal plane and the vertical plane.

When Mikheev's method is used to calculate the convective heat transfer coefficient η, important parameters are respective characteristic lengths Lu, Lh, and Ld, of the top, lateral, and bottom surfaces. Since the heating roller 231 has a uniform axial length, however, it makes no substantial difference which of the characteristic lengths or the projected areas is taken into consideration. With regard to the projected area Sh, there is no need to consider a sum of respective projected areas on leftward and rightward vertical planes, but either one of the areas are to be considered.

When positioned vertically upwards with reference to the heating roller 231, the heat reflector 238 has a maximum convective heat transfer coefficient η of 1. When positioned vertically downwards, the heat reflector 238 has a minimum convective heat transfer coefficient η of 0.54. Thus, the convective heat transfer coefficient η provides a simplified indication of amount of convective heat loss from the heat reflector 238. The convective heat loss is reduced to a much lower level by determining a form and a position of the heat reflector 238 such that the convective heat transfer coefficient η becomes as small as possible.

Figure 7:
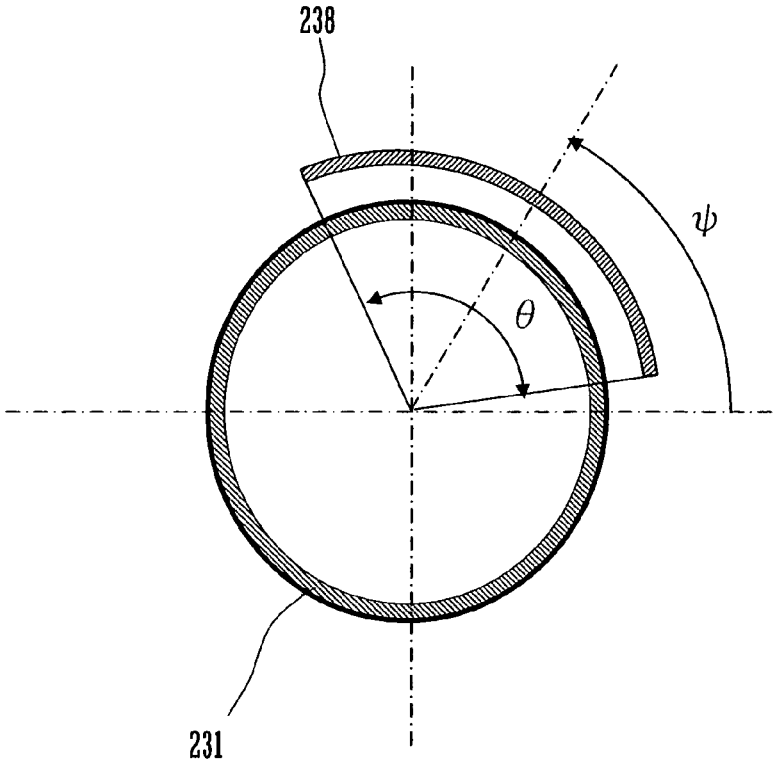
FIG. 7(*a*) is a table showing convective heat transfer coefficient η, and FIG. 7(*b*) is a diagram illustrating a configuration, and a position, of the heat reflector.

Shown in FIG. 7(*a*) are convective heat transfer coefficients q with various sizes and positions of the heat reflector 238, calculated from the Expression (1). As shown in FIG. 7(*b*), the heat reflector 238 has an arc-shaped cross-section such as conventional heat reflectors have. The various sizes of the heat reflector 238 are indicated by central angles θ whose arc is a cross-section of the heat reflector 238. The various positions of the heat reflector 238 are indicated by angles ψ of inclination with respect to a horizontal plane of a line connecting a circumferential center of the heat reflector 238 and a center of the arc that is the cross-section of the heat reflector 238.

The convective heat transfer coefficient η becomes larger than 0.9, as in conventional heat reflectors 1 and 2 as shown in FIG. 7(*a*), when the heat reflector 238 is positioned in a conventional manner above the heating roller 231 (i.e., with the angle ψ equal to 90°), or more specifically, when the heat reflector 238 is positioned so as to face an upper circumferential surface of the heating roller 231.

In contrast, the convective heat transfer coefficient η becomes 0.9 or smaller, as in heat reflectors 1 to 5 according to the invention as shown in FIG. 7(*a*), when the heat reflector 238 is positioned laterally or downward with respect to the heating roller 231, or more specifically, when the heat reflector 238 is positioned so as to face a lateral or lower circumferential surface of the heating roller 231. Consequently, heat loss from the outer surface of the heat reflector 238 is reduced and heat-retaining properties of the heating roller 231 are improved.

From a perspective of heat retention, therefore, it is preferable to position the heat reflector 238 laterally or downwards with respect to the heating roller 231. In the present embodiment, the sheet transport path is formed such that the sheet transport direction is vertically upwards in the fusing device 23. Thus, the heating roller 231 and the pressure roller 232 are horizontally aligned with the sheet transport path sandwiched therebetween. Further, the external heating roller 233 is positioned below the pressure roller 232.

The foregoing arrangement allows the heat reflector 238 to be located laterally with respect to the heating roller 231. The arrangement also allows the heat reflector 239 to be located downwards with reference to the external heating roller 233.

As shown in FIG. 7(*a*), the heat reflector 238 has a convective heat transfer coefficient η of 0.77, while the heat reflector 239 has a convective heat transfer coefficient η of 0.62. Thus, heat loss from the heat reflectors 238 and 239 is reduced, and heat-retaining properties of the heating roller 231 and the external heating roller 233 are enhanced.

When the heat reflector 238 is positioned laterally with respect to the heating roller 231, a space between the heat reflector 238 and the heating roller 231 is open in an upward direction. Thus, hot air in the space rises and is likely to escape from the space.

In the present embodiment, therefore, the PCU board adjusts rotation speed of the heating roller 231 so that the hot air in the space may not escape.

When the fusing device 23 is arranged so that the sheet transport direction is vertically upward, the heating roller 231 is rotated in a downward direction on a side facing the heat reflector 238. Frictional resistance created between hot air in the space and the circumferential surface of the heating roller 231 being rotated downward acts as a force to cause a downward flow of hot air. The hot air around the heating roller 231 is thus prevented from escaping, so that the heating roller 231 has enhanced heat-retaining properties. A more detailed discussion about the foregoing is presented below.

Frictional resistance Ff created between a uniform flow of air and a flat plate placed therein is given by the following Expressions (2) to (4), where Cf is frictional resistance coefficient, Re is Reynolds number, A is area of flat plate, ρ is air density, ν is air kinematic viscosity, V is air flow rate, and 1 is width of flat plate.

$$Ff=Cf*A*\rho*V^2/2 \qquad \text{Expression (2)}$$

$$Re=V*1/\nu \qquad \text{Expression (3)}$$

When the boundary layer is laminar for lower Reynolds numbers than $10^5$, $$Cf=1.328/\sqrt{Re}(Re<10^5) \qquad \text{Expression (4-1)}$$

When the boundary layer is turbulent for Reynolds numbers equal to, and higher than, $10^5$, $$Cf=0.074/Re^{1/5}(Re<5*10^6) \qquad \text{Expression (4-2)}$$

$$Cf=0.455/(\log Re)^{2.58}(Re>10^7) \qquad \text{Expression (4-3)}$$

A portion of the heating roller 231 covered with the heat reflector 238 has a semi-cylindrical shape. A planar development of the portion provides some parameters for the Expressions (2) to (4):

from length of the heating roller 231, 1=0.32 (m);

from diameter of the heating roller 231, D=0.04 (m);

therefore, A=π*D*½ (m); and from the circumferential velocity of the heating roller 231, V=0.365 (m).

Also, since the air in the space between the heating roller 231 and the heat reflector 238 has a temperature of approximately 140° C., $$\nu=28.6*10^{-6}(m^2/s); \text{ and}$$

$$\rho=0.827(Kg/m^3)$$

Further, obtained from the expression (3) is:

$$Re = 0.365*0.32/28.6*10^{-6}$$
$$= 4.08*10^{-8}.$$

Because $Re<10^5$, the boundary layer is laminar, and the following Expression (5) is derived from the Expressions (2) and (4-1).

$$Ff=(1.328/\sqrt{Re})*A*\rho V^2/2 \qquad \text{Expression (5)}$$

Figure 8:
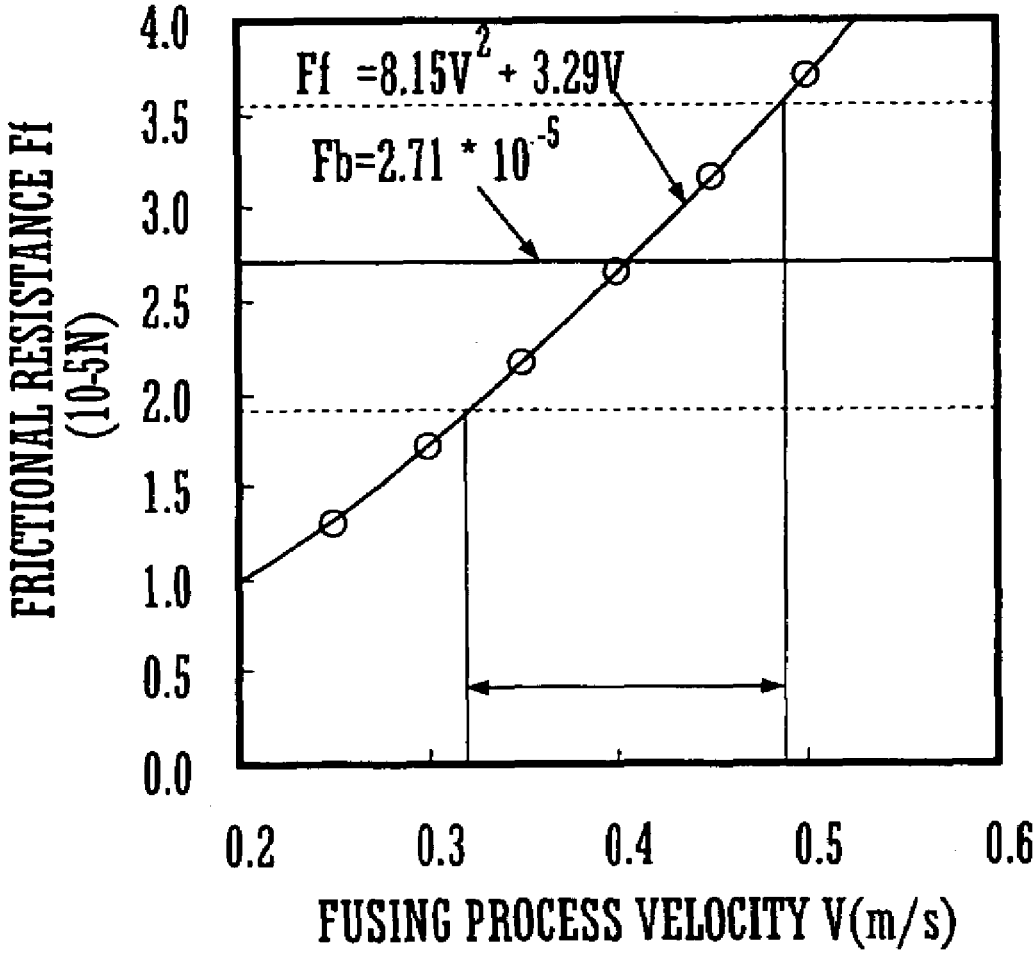
FIG. 8 is a graph indicating relationship among fusing velocity V, frictional resistance Ff, and air buoyancy Fb.

FIG. 8 shows the friction resistance Ff as given by the expression (4), with the circumferential velocity V varied within a range of 0.25 to 0.50 (m/s). As shown in FIG. 8, the relationship between the circumferential velocity V and the frictional resistance Ff is given by the following approximate Expression (6):

$$Ff=8.15V^2+3.19V \qquad \text{Expression (6)}$$

Buoyancy of air heated in the above-mentioned space is obtained in a simplified manner as below.

$$Fb=\{\rho(TO)-\rho(Ta)\}*Va, \qquad \text{Expression (7)}$$

where Fb is buoyancy of air in the space, TO is temperature of ambient air, Ta is temperature of air in the space, ρ(TO) is air density at the temperature TO, ρ(Ta) is air density at the temperature Ta, and Va is volume of air in the space.

Accordingly, when the circumferential velocity of the heating roller 231 is set so as to satisfy the expression Ff≈Fb, heat loss due to the rise of heated air in the space is reduced to a minimum level, even when the heat reflector 238 is positioned laterally with respect to the heating roller 231.

With the temperature Ta at 140° C. and the temperature TO at 110° C., $$\rho(TO)=0.913(\text{kg/m}^3)$$

$$\rho(Ta)=0.827(\text{kg/m}^3)$$

and therefore, $Fb=2.71*10^{-5}$ (N).

In the present embodiment, the frictional resistance Ff is set, so as to satisfy the expression Ff≈Fb, within an optical range as given by the following expression:

$$0.7Fb \leqq Ff \leqq 1.3\ Fb \qquad \text{Expression (8):}$$

From the Expression (6), the circumferential velocity V of the heating roller 231 that satisfies the Expression (8) is obtained, as given by the following expression:

$$0.32(m/s) \leqq V \leqq 0.49(m/s) \qquad \text{Expression (9):}$$

Therefore, the present embodiment sets the circumferential velocity V to 0.365 (m/s), thereby preventing hot air from escaping from the space.

Described below is an optimal configuration of the heat reflector 238. When the heat reflector 238 of arc shape is positioned laterally with respect to the heating roller 231 as in the present embodiment, there is a temperature gradient generated across the heat reflector 238, i.e., between an upper portion, which radiates more heat, and a middle portion or a lower portion, which radiates less heat. Thus, heat is likely to be conducted from the middle or the lower portion to the upper portion. Since inhibition of the heat conduction results in prevention of convective heat loss from the heat reflector 238 as a whole, it is preferable that a material for the heat reflector 238 has a low thermal conductivity.

Specifically, a preferable metal material for the heat reflector 238 is a stainless-steel material as used in the present embodiment, which has a low thermal conductivity. Alternatively, the heat reflector 238 includes, as a base material, a heat-resisting resin material of lower thermal conductivity than metals, and a surface of the base material is plated so as to have heat reflecting properties.

Figure 9:
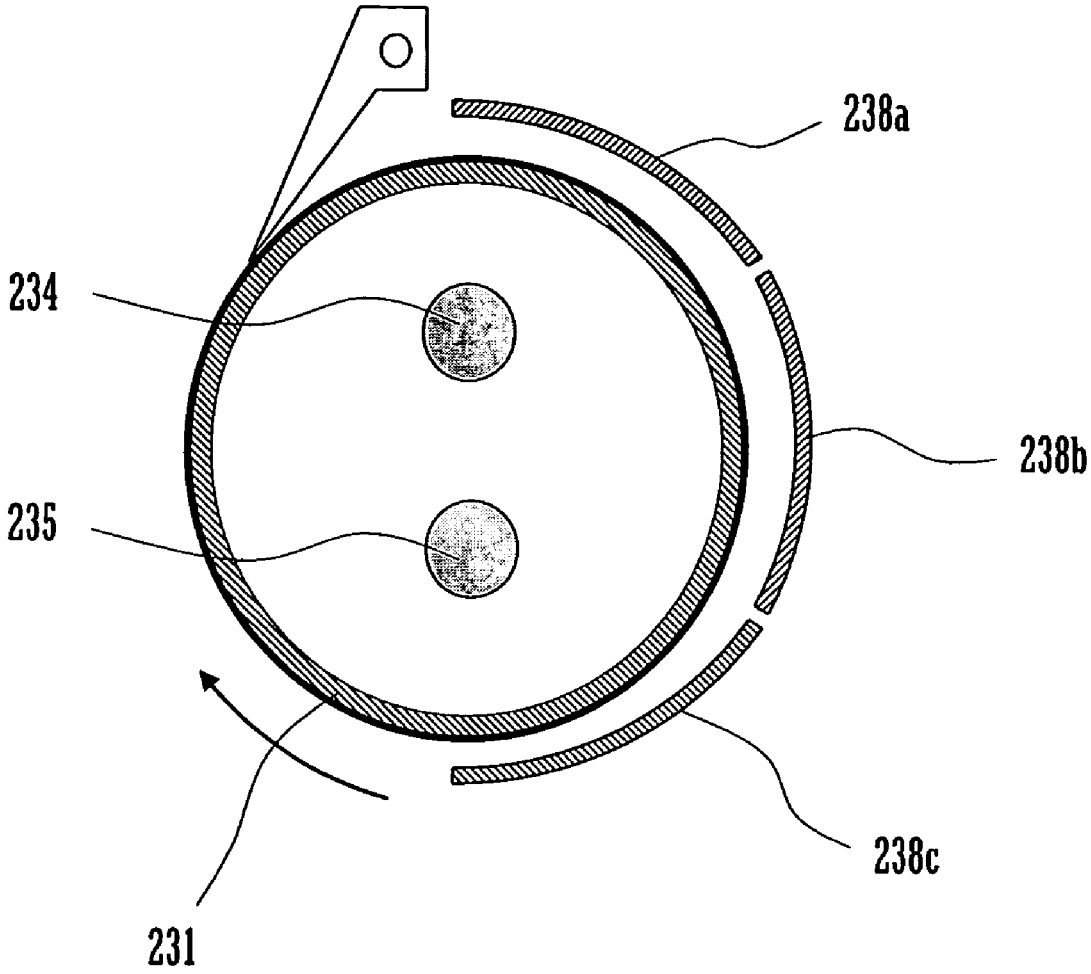
FIG. 9 is a diagram for illustrating a configuration of a heat reflector divided into multiple parts along a circumferential direction thereof.

Further, it is possible to divide the heat reflector 238 into multiple parts along a circumferential direction thereof, i.e., into an upper part 238*a*, a middle part 238*b*, and a lower part 238*c*, as shown in FIG. 9. Thus, heat transfer from the middle part 238*b* or the lower part 238*c* to the upper part 238*a* is inhibited, so that convective heat loss from the heat reflector 238 as a whole is reduced.

According to the present embodiment, as described above, the fusing device 23 is less likely to cause a toner image to be improperly fused because of insufficiency of heat, even when the fusing device 23 is installed in a high-speed printing machine that allows a sheet to be transported through a fusing nip area in 23 or less msec.

It is to be noted that the heating device of the invention includes, but is not limited to, fusing devices provided in electrophotographic image forming apparatuses such as described in the foregoing embodiments. The heating device of the invention is also applicable to drying devices for use in wet-type electrophotographic image forming apparatuses or ink jet printers, erasing devices for rewritable media, and so on.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A heating device, comprising:

a heating member for heating a medium to be heated, the heating member being arranged so as to be close to a transport path on which the medium is transported, the transport path extending inside the heating device being substantially perpendicular to a horizontal plane; and a first heat reflector for reflecting radiant heat from the heating member, the first heat reflector being positioned across the heating member from the transport path so as to face the heating member, wherein the first heat reflector is located at a predetermined position around the heating member so as to have a convective heat transfer coefficient η of 0.9 or smaller, the convective heat transfer coefficient η being given by the following equation:

$$\eta=(Su+0.77Sh+0.54Sd)/(Su+Sh+Sd),$$

where Su is an area projected on an upper horizontal plane, of an outer surface of the first heat reflector, Sh is an area of the same projected on a vertical plane, and Sd is an area of the same projected on a lower horizontal plane, wherein the heating member includes a heating roller and a pressure roller, the heating roller and the pressure roller being arranged on respective sides of the transport path so as to be pressed against each other, and wherein the first heat reflector is positioned so as to cover at least a circumferential surface of the heating roller, the heating device, further comprising:

a velocity adjusting section for adjusting a circumferential velocity V of the heating roller so that the circumferential velocity V falls within a range given by the following inequality: 0.32 (m/s)≦V≦0.49 (m/s).

2. A heating device, comprising:

a heating member for heating a medium to be heated, the heating member being arranged so as to be close to a transport path on which the medium is transported, the transport path extending inside the heating device being substantially perpendicular to a horizontal plane; and a first heat reflector for reflecting radiant heat from the heating member, the first heat reflector being positioned across the heating member from the transport path so as to face the heating member, wherein the first heat reflector is located at a predetermined position around the heating member so as to have a convective heat transfer coefficient η of 0.9 or smaller, the convective heat transfer coefficient η being given by the following equation:

$$\eta=(Su+0.77Sh+0.54Sd)/(Su+Sh+Sd),$$

where Su is an area projected on an upper horizontal plane, of an outer surface of the first heat reflector, Sh is an area of the same projected on a vertical plane, and Sd is an area of the same projected on a lower horizontal plane, wherein the heating member includes a heating roller and a pressure roller, the heating roller and the pressure roller being arranged on respective sides of the transport path so as to be pressed against each other, and wherein the first heat reflector is positioned so as to cover at least a circumferential surface of the heating roller, the heating device, further comprising:

an external heating roller for pressing against and heating the pressure roller; and a second heat reflector for reflecting radiant heat from the external heating roller, the second heat reflector being positioned so as to face the external heating roller, wherein the external heating roller is positioned in contact with the pressure roller at an area on a lower half of a circumferential surface of the pressure roller.

3. A heating device, comprising:

a heating member for heating a medium to be heated, the heating member being arranged so as to be close to a transport path on which the medium is transported, the transport path extending inside the heating device being substantially perpendicular to a horizontal plane; and a first heat reflector for reflecting radiant heat from the heating member, the first heat reflector being positioned across the heating member from the transport path so as to face the heating member, wherein the first heat reflector is located at a predetermined position around the heating member so as to have a convective heat transfer coefficient η of 0.9 or smaller, the convective heat transfer coefficient η being given by the following equation:

$$\eta=(Su+0.77Sh+0.54Sd)/(Su+Sh+Sd),$$

where Su is an area projected on an upper horizontal plane, of an outer surface of the first heat reflector, Sh is an area of the same projected on a vertical plane, and Sd is an area of the same projected on a lower horizontal plane, wherein the heating member includes a heating roller and a pressure roller, the heating roller and the pressure roller being arranged on respective sides of the transport path so as to be pressed against each other, wherein the first heat reflector is positioned so as to cover at least a circumferential surface of the heating roller, and wherein the first heat reflector is divided into multiple parts along a circumferential direction thereof.

4. A heating device, comprising:

a heating member for heating a medium to be heated, the heating member being arranged so as to be close to a transport path on which the medium is transported, the transport path extending inside the heating device being substantially perpendicular to a horizontal plane; and a first heat reflector for reflecting radiant heat from the heating member, the first heat reflector being positioned across the heating member from the transport path so as to face the heating member, wherein the first heat reflector is located at a predetermined position around the heating member so as to have a convective heat transfer coefficient η of 0.9 or smaller, the convective heat transfer coefficient η being given by the following equation:

$$\eta=(Su+0.77Sh+0.54Sd)/(Su+Sh+Sd),$$

where Su is an area projected on an upper horizontal plane, of an outer surface of the first heat reflector, Sh is an area of the same projected on a vertical plane, and Sd is an area of the same projected on a lower horizontal plane, wherein the heating member includes a heating roller and a pressure roller, the heating roller and the pressure roller being arranged on respective sides of the transport path so as to be pressed against each other, wherein the first heat reflector is positioned so as to cover at least a circumferential surface of the heating roller, and wherein at least one of the first heat reflector and the second heat reflector includes a material of low thermal conductivity.

5. A heating device, comprising:

a heating roller and a pressure roller for heating a medium to be heated, the heating roller and the pressure roller being arranged on respective sides of the transport path so as to be pressed against each other;

a heat reflector for reflecting radiant heat from the heating roller, the heat reflector being positioned across the heating roller from the transport path so as to face the heating roller; and a velocity adjusting section for adjusting a circumferential velocity V of the heating roller so that the circumferential velocity V falls within a range given by the following inequality: $0.32\ (m/s) \leqq V \leqq 0.49\ (m/s)$, wherein the heat reflector is located at a predetermined position around the heating roller so as to cover at least a circumferential surface of the heating roller and to have a convective heat transfer coefficient η of 0.9 or smaller, the convective heat transfer coefficient η being given by the following equation:

$$\eta=(Su+0.77Sh+0.54Sd)/(Su+Sh+Sd),$$

where Su is an area projected on an upper horizontal plane, of an outer surface of the heat reflector, Sh is an area of the same projected on a vertical plane, and Sd is an area of the same projected on a lower horizontal plane.

* * * * *